US008827437B2

(12) United States Patent
Yokozawa et al.

(10) Patent No.: US 8,827,437 B2
(45) Date of Patent: Sep. 9, 2014

(54) PRINTING METHOD AND PRINTER

(75) Inventors: Toshihiro Yokozawa, Shiojiri (JP); Masahiro Ido, Chino (JP)

(73) Assignee: Seiko Epson Corporation (JP)

( * ) Notice: Subject to any disclaimer, the term of this patent is extended or adjusted under 35 U.S.C. 154(b) by 177 days.

(21) Appl. No.: 13/301,010

(22) Filed: Nov. 21, 2011

(65) Prior Publication Data

US 2012/0133721 A1 May 31, 2012

(30) Foreign Application Priority Data

Nov. 30, 2010 (JP) ..... 2010-267396

(51) Int. Cl.

| | |
|---|---|
| ***B41J 2/01*** | (2006.01) |
| ***B41J 29/38*** | (2006.01) |
| ***B41M 5/00*** | (2006.01) |
| ***B41J 11/00*** | (2006.01) |

(52) U.S. Cl.

CPC ..... *B41J 11/002* (2013.01); *B41M 5/0011* (2013.01); *B41M 2205/12* (2013.01)

USPC ..... 347/101; 347/9

(58) Field of Classification Search

None

See application file for complete search history.

(56) References Cited

U.S. PATENT DOCUMENTS

| | | | | |
|---|---|---|---|---|
| 5,511,477 | A * | 4/1996 | Adler et al. | 101/401.1 |
| 5,896,154 | A * | 4/1999 | Mitani et al. | 347/102 |
| 2009/0207203 | A1 * | 8/2009 | Yamamoto | 347/16 |

FOREIGN PATENT DOCUMENTS

| | | | | |
|---|---|---|---|---|
| JP | 2003-080687 | | 3/2003 | |
| JP | 2003-145728 | * | 5/2003 | |
| JP | 2003145728 A | * | 5/2003 | B41J 2/01 |
| JP | 2004-283635 | | 10/2004 | |
| JP | 2010-100011 | | 5/2010 | |
| JP | 2010-161251 | | 7/2010 | |

* cited by examiner

*Primary Examiner* — Alessandro Amari

*Assistant Examiner* — Alexander C Witkowski

(74) *Attorney, Agent, or Firm* — Harness, Dickey & Pierce, P.L.C.

(57) ABSTRACT

A printing method includes preprocessing a substrate by irradiating the substrate in a heated state with an activation light beam, and printing, after the preprocessing, a predetermined pattern on the substrate by ejecting a droplet to the substrate.

8 Claims, 6 Drawing Sheets

PRINTING METHOD AND PRINTER

BACKGROUND

1. Technical Field

The present invention relates to a printing method and a printer.

2. Related Art

There have been widely adopted a method of applying a functional fluid using an inkjet process of ejecting the functional fluid as droplets, and then solidifying the functional fluid thus applied to thereby form a film. Further, as the functional fluid there are used a variety of fluid like substances such as a fluid including dyes or pigments and having a function of coloring or a fluid including metal particles and having a function of forming metal wiring.

JP-A-2004-283635 discloses a droplet ejection device for applying a functional fluid to a substrate using an inkjet process. The droplet ejection device is provided with a stage for moving the substrate and a carriage for moving a droplet ejection head. The droplet ejection head is provided with nozzles for ejecting droplets. The moving directions of the stage and the carriage are perpendicular to each other. Further, when the droplet ejection head is located at a place opposed to a place to be coated with the functional fluid, the droplets are ejected. Further, by landing the functional fluid at predetermined positions, the substrate is printed with a predetermined pattern.

However, in the related art described above, there exists the following problem.

In some cases the pattern printed by ejecting the droplets on the substrate breaks away from the substrate, and therefore, a technology for improving the adhesiveness of the pattern with respect to the substrate is requested.

SUMMARY

An advantage of some aspect of the invention is to provide a printing method and a printer improving the adhesiveness of the printed pattern.

An aspect of the invention is directed to a printing method including preprocessing a substrate by irradiating the substrate in a heated state with an activation light beam, and printing, after the preprocessing, a predetermined pattern on the substrate by ejecting a droplet to the substrate.

Therefore, according to the printing method of this aspect of the invention, the surface of the substrate can be reformulated by irradiating the substrate with the activation light beam such as an ultraviolet ray in the preprocessing, and at the same time, the adhesiveness of the predetermined pattern printed on the substrate in the printing with respect to the substrate can be improved by eliminating the organic substances on the surface of the substrate.

Further, in the preprocessing of the above aspect of the invention, a procedure of heating the substrate at a temperature equal to or lower than the allowable temperature limit of the substrate can preferably adopted. In this case, it is preferable to heat the substrate at a temperature in a range of 150° C. through 200° C. from the viewpoint of reformulating the surface of the substrate with a predetermined characteristic.

Thus, according to this aspect of the invention, it becomes possible to improve the adhesiveness of the predetermined pattern printed on the substrate with respect to the substrate without damaging the substrate.

The aspect of the invention may preferably be configured such that the droplet to be ejected to the substrate is a droplet of a fluid curing with the activation light beam.

Thus, according to this configuration, both of the improvement in the adhesiveness of the print pattern to the substrate and the curing of the droplet ejected to the substrate can be performed using the same light source, which can make a contribution to downsizing and price reduction of the device.

The aspect of the invention may preferably be configured such that the activation light beam is an ultraviolet ray.

Thus, according to this configuration, since there is adopted the configuration of emitting the ultraviolet ray using, for example, the low-pressure mercury vapor lamp, the reformulation process of the substrate can be performed at low voltage, and at the same time, the printing can efficiently be performed using the heat generated by the irradiation of the ultraviolet ray.

In the printing, in the case of printing the predetermined pattern on the semiconductor device disposed on the substrate, the print pattern representing the attribute information of the semiconductor device can be deposited with a high adhesiveness.

Another aspect of the invention is directed to a printer including a preprocessing section adapted to irradiate a substrate with an activation light beam while heating the substrate, and a printing section adapted to print a predetermined pattern on the substrate by ejecting a droplet to the substrate.

Therefore, according to the printer of this aspect of the invention, the surface of the substrate can be reformulated by irradiating the substrate with the activation light beam such as an ultraviolet ray in the preprocessing section, and at the same time, the adhesiveness of the predetermined pattern printed on the substrate in the printing section with respect to the substrate can be improved by eliminating the organic substances on the surface of the substrate.

BRIEF DESCRIPTION OF THE DRAWINGS

The invention will be described with reference to the accompanying drawings, wherein like numbers reference like elements.

DESCRIPTION OF AN EXEMPLARY EMBODIMENT

Figure 1A:
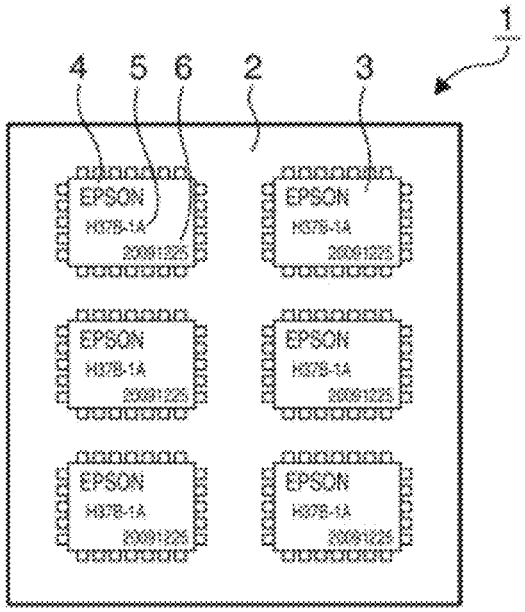
FIG. 1A is a schematic plan view showing a semiconductor circuit board.

Hereinafter, a printing method and a printer according to an embodiment of the invention will be explained with reference to FIGS. 1A through 7.

It should be noted that the embodiment shows an aspect of the invention, but do not limit the scope of the invention, and can arbitrarily be modified within a technical concept of the invention. Further, in the drawings explained hereinafter, in order to make each constituent easy to understand, the actual structures and the structures of the drawings are made different from each other in scale size, number, and so on.

In the present embodiment, an example of the printer characteristic for the invention and the printing method of performing printing by ejecting droplets using the printer will be explained with reference to FIGS. 1A through 7.

Semiconductor Circuit Board

Firstly, a semiconductor circuit board as an example of an object on which drawing is performed using the printer will be explained.

FIG. 1A is a schematic plan view showing the semiconductor circuit board. As shown in FIG. 1A, the semiconductor circuit board 1 as a base member is provided with a board 2. The board 2 is only required to have heat resistance and to be able to mount semiconductor devices 3, and a glass epoxy board, a paper phenolic board, a paper epoxy board, and so on can be used as the board 2.

The semiconductor devices 3 are mounted on the board 2. Further, marks (print patterns, predetermined patterns) such as a company name mark 4, a model code 5, and a serial number 6 are drawn on each of the semiconductor devices 3. These marks are drawn using the printer.

Printer

Figure 1B:
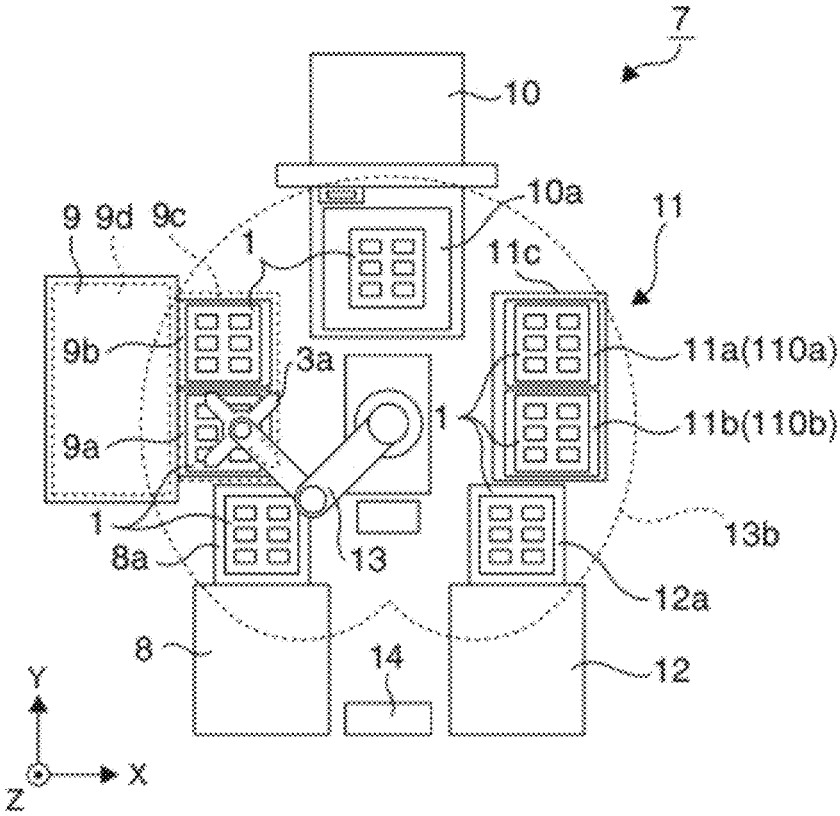
FIG. 1B is a schematic plan view showing a droplet ejection device.

FIG. 1B is a schematic plan view showing the printer.

As shown in FIG. 1B, the printer 7 is mainly composed of a supply section 8, a preprocessing section 9, an application section (a printing section) 10, a cooling section 11, a storage section 12, a conveying section 13, and a control section 14. In the printer 7, the supply section 8, the preprocessing section 9, the application section 10, the cooling section 11, the storage section 12, and the control section 14 are disposed in this order clockwise centered on the conveying section 13. Further, the supply section 8 is disposed adjacent to the control section 14. The direction along which the supply section 8, the control section 14, and the storage section 12 are arranged is defined as an X direction. The direction perpendicular to the X direction is defined as a Y direction, and the application section 10, the conveying section 13, and the control section 14 are arranged in the Y direction. Further, the vertical direction is defined as a Z direction.

The supply section 8 is provided with a storage container in which a plurality of semiconductor circuit boards 1 is stored. Further, the supply section 8 is provided with a staging place 8*a*, and supplies the semiconductor circuit board 1 from the storage container to the staging place 8*a*.

The preprocessing section 9 has a function of reforming a surface of the semiconductor device 3 while heating the surface thereof. Due to the preprocessing section 9, the semiconductor device 3 is adjusted in the spread of the droplet ejected thereon and adhesiveness of the marks to be printed thereon. The preprocessing section 9 is provided with a first staging place 9*a* and a second staging place 9*b*, and takes in the semiconductor circuit board 1 from the first staging place 9*a* or the second staging place 9*b* to perform the reformulation of the surface of the semiconductor devices 3. Subsequently, the preprocessing section 9 moves the semiconductor circuit board 1 after performing the process thereon to the first staging place 9*a* or the second staging place 9*b*, and then makes the semiconductor circuit board 1 stand ready. The first staging place 9*a* and the second staging place 9*b* are collectively referred to as a staging place 9*c*. Further, the place where the preprocessing is performed in the preprocessing section 9 is referred to as a processing place 9*d*.

The cooling section 11 has a function of cooling the semiconductor circuit board 1 on which the heating and surface reformulation have been performed in the preprocessing section 9. The cooling section 11 has processing places 11*a*, 11*b* each for holding and cooling the semiconductor circuit board 1. The processing places 11*a*, 11*b* are collectively referred to as a processing place 11*c* if appropriate.

The application section 10 has a function of ejecting the droplets to and thereby drawing (printing) the marks on the semiconductor devices 3, and at the same time, solidifying or curing the marks thus drawn thereon. The application section 10 is provided with a staging place 10*a*, and moves the semiconductor circuit board 1 before drawing from the staging place 10*a* and then performs the drawing process and the curing process. Subsequently, the application section 10 moves the semiconductor circuit board 1 after drawing to the staging place 10*a*, and then makes the semiconductor circuit board 1 stand ready.

The storage section 12 is provided with a storage container capable of storing a plurality of semiconductor circuit board 1. Further, the storage section 12 is provided with a staging place 12*a*, and stores the semiconductor circuit board 1 from the staging place 12*a* to the storage container. The operator takes out the storage container storing the semiconductor circuit boards 1 from the printer 7.

A conveying section 13 is disposed in the central place of the printer 7. As the conveying section 13, a scalar robot provided with two arm sections is used. Further, a grip section 13*a* for gripping the semiconductor circuit board 1 is disposed at the tip of the arm. The staging places 8*a*, 9*c*, 10*a*, 11*c*, and 12*a* are located in a moving range 13*b* of the grip section 13*a*. Therefore, the grip section 13*a* is capable of moving the semiconductor circuit board between the staging places 8*a*, 9*c*, 10*a*, 11*c*, and 12*a*. The control section 14 is a device for controlling the overall operation of the printer 7, and manages the operating condition of each of the constituents of the printer 7. Further, the control section 14 outputs an instruction signal for moving the semiconductor circuit board to the conveying section 13. Thus, it is arranged that the drawing is performed on the semiconductor circuit board 1 while the semiconductor circuit board 1 sequentially passes through the constituents of the printer 7.

Hereinafter, the details of the constituents will be explained.

Supply Section

Figure 2A:
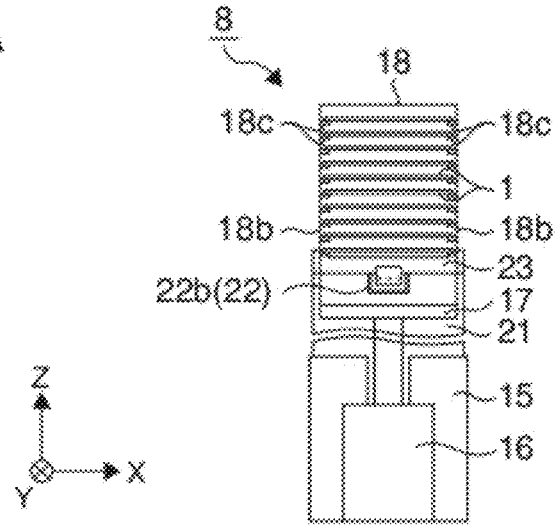
FIGS. 2A through 2C are schematic diagrams showing a supply section.
Figure 2B:
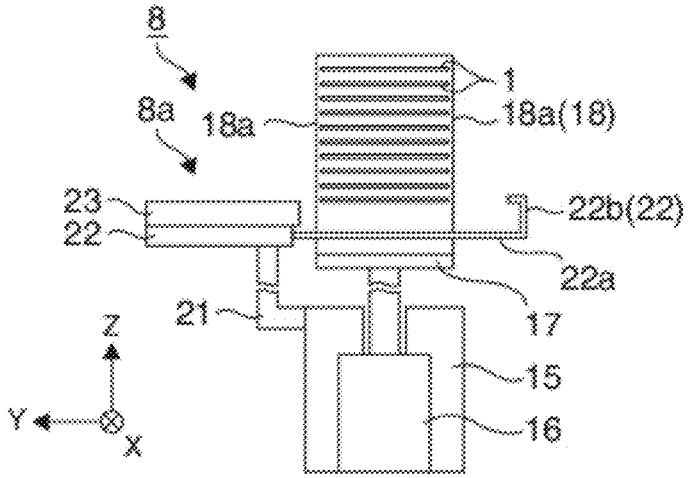
Figure 2C:
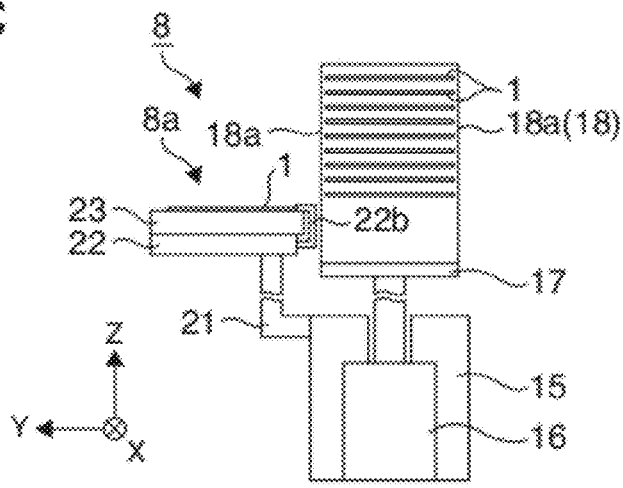

FIG. 2A is a schematic front view showing the supply section, and FIGS. 2B and 2C are schematic side views showing the supply section. As shown in FIGS. 2A and 2B, the supply section 8 is provided with abase 15. Inside the base 15, there is installed an elevating device 16. The elevating device 16 is provided with a translation mechanism acting in the Z direction. As the translation mechanism, a mechanism such as a combination of a ball screw and a rotary motor or a combination of a hydraulic cylinder and an oil pump can be used. In the present embodiment, the mechanism composed of a ball screw and a step motor is adopted, for example. Above the base 15, there is disposed an elevating plate 17 connected to the elevating device 16. Further, the elevating plate 17 is arranged to be able to rise and fall as much as a predetermined distance due to the elevating device 16.

On the elevating plate 17, there is disposed a storage container 18 having a rectangular solid shape, and a plurality of semiconductor circuit boards 1 is stored in the storage container 18. The storage container 18 is provided with opening sections 18*a* in the both side faces located in the Y direction, and it is arranged that the semiconductor circuit board 1 can be taken in and out through the opening sections 18*a*. Inside the side faces 18*b* located on both sides in the X direction of the storage container 18, there are formed rails 18*c* each having a convex shape, and the rails 18*c* are disposed extending in the Y direction. The rails 18*c* are arranged in the Z direction at regular intervals. By inserting the semiconductor circuit boards 1 along the rails 18*c* from the Y direction or the −Y direction, the semiconductor circuit boards 1 are stored so as to be arranged in the Z direction.

On the Y-direction side of the base 15, there are disposed a board pullout section 22 and a staging platform 23 via a support member 21. In the place located on the Y-direction side of the storage container 18, the staging platform 23 is disposed overlapping above the board pullout section 22. The board pullout section 22 is provided with an arm 22*a* elongated and contracted in the Y direction, and a translation mechanism for driving the arm 22*a*. The translation mechanism is not particularly limited providing the mechanism moves linearly, and in the present embodiment, an air cylinder acting by the compressed air is adopted, for example. At one end of the arm 22*a*, there is disposed a click section 22*b* bent to form a roughly rectangular shape, and the tip of the click section 22*b* is formed in parallel to the arm 22*a*.

When the board pullout section 22 extends the arm 22*a*, the arm 22*a* penetrates the storage container 18. Then, the click section 22*b* moves to the −Y-direction side of the storage container 18. Subsequently, after the elevating device 16 moves down the semiconductor circuit board 1, the board pullout section 22 contracts the arm 22*a*. On this occasion, the click section 22*b* moves while pushing one end of the semiconductor circuit board 1.

As a result, as shown in FIG. 2C, the semiconductor circuit board 1 is moved from the storage container 18 to the upper surface of the staging platform 23. The staging platform 23 is provided with a recessed section having a width roughly the same as the X-direction width of the semiconductor circuit board 1, and the semiconductor circuit board 1 moves along the recessed section. Further, the recessed section determines the position of the semiconductor circuit board 1 in the X direction. The place where the semiconductor circuit board 1 is stopped while being pushed by the click section 22*b* determines the position of the semiconductor circuit board in the Y direction. The upper surface of the staging platform 23 corresponds to the staging place 8*a*, and the semiconductor circuit board 1 stands ready at a predetermined place in the staging place 8*a*. When the semiconductor circuit board 1 stands ready in the staging place 8*a* of the supply section 8, the conveying section 13 moves the grip section 13*a* to the place opposed to the semiconductor circuit board 1, and then grips and moves the semiconductor circuit board 1.

After the semiconductor circuit board 1 is moved by the conveying section 13 from the upper surface of the staging platform 23, the board pullout section 22 extends the arm 22*a*. Subsequently, the elevating device 16 moves down the storage container 18, and then the board pullout section 22 moves the semiconductor circuit board 1 from the inside of the storage container 18 to the upper surface of the staging platform 23. In a manner as described above, the supply section 8 moves the semiconductor circuit board 1 from the storage container 18 to the upper surface of the staging platform 23 one-by-one. After moving all of the semiconductor circuit boards 1 located inside the storage container 18 to the upper surface of the staging platform 23, the operator replaces the storage container 18 thus emptied with the storage container 18 with the semiconductor circuit boards 1 stored. Thus, the supply section 8 can be supplied with the semiconductor circuit boards 1.

Preprocessing Section

Figure 3A:
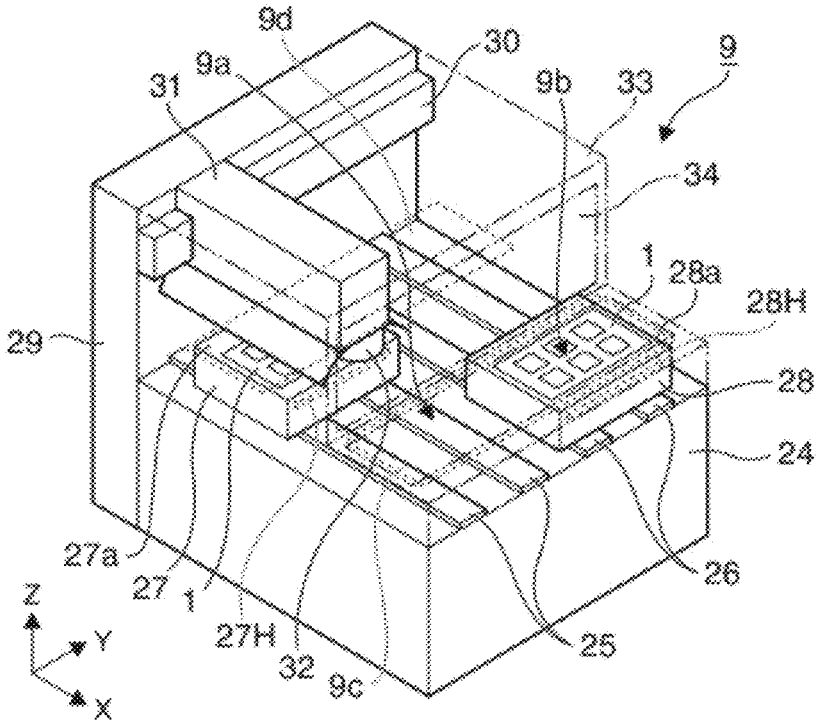
FIGS. 3A and 3B are schematic perspective views showing a configuration of a preprocessing section.
Figure 3B:
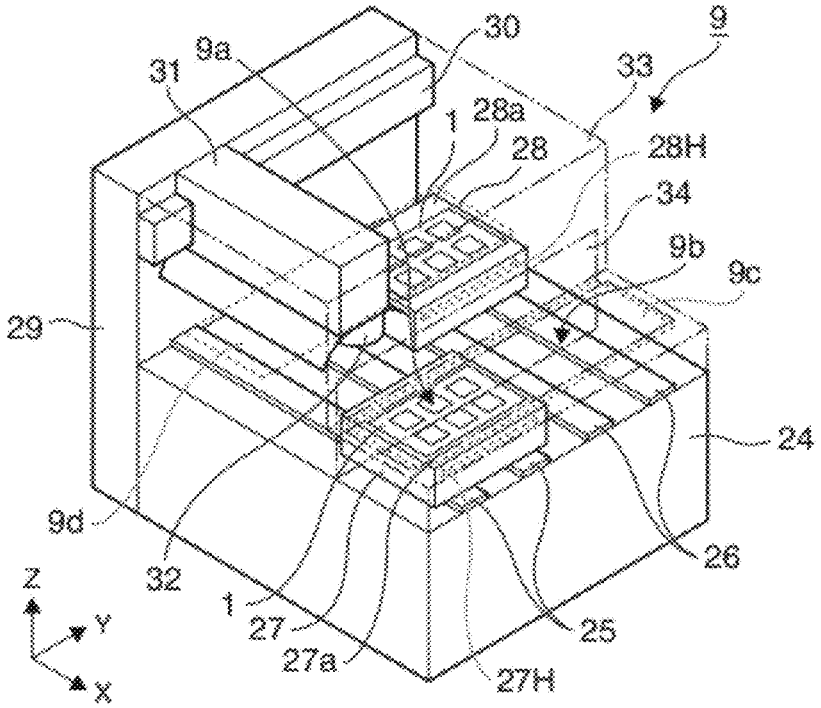

FIGS. 3A and 3B are schematic perspective views showing a configuration of the preprocessing section. As shown in FIG. 3A, the preprocessing section 9 is provided with a base 24, and a pair of first guide rails 25 and a pair of second guide rails 26 extending in the X direction are disposed side-by-side on the base 24. On the first guide rails 25, there is disposed a first stage 27 as a mounting platform reciprocating in the X direction along the first rails 25, and on the second guide rails 26, there is disposed a second stage 28 as a mounting platform reciprocating in the X direction along the second rails 26. The first stage 27 and the second stage 28 are each provided with a translation mechanism, and is capable of reciprocating. As the translation mechanism, a mechanism substantially the same as the translation mechanism provided to the elevating device 16 can be used, for example.

On the upper surface of the first stage 27, there is disposed a mounting surface 27*a*, and the mounting surface 27*a* is provided with a suction type chuck mechanism. By the conveying section 13 mounting the semiconductor circuit board 1 on the mounting surface 27*a* and then operating the chuck mechanism, the preprocessing section 9 can fix the semiconductor circuit board 1 to the mounting surface 27*a*. Similarly, on the upper surface of the second stage 28, there is also disposed a mounting surface 28*a*, and the mounting surface 28*a* is provided with a suction type chuck mechanism. By the conveying section 13 mounting the semiconductor circuit board 1 on the mounting surface 28*a* and then operating the chuck mechanism, the preprocessing section 9 can fix the semiconductor circuit board 1 to the mounting surface 28*a*.

The first stage 27 incorporates a heating device 27H to thereby heat the semiconductor circuit board 1 mounted on the mounting surface 27*a* to predetermined temperature under the control of the control section 14. Similarly, the second stage 28 incorporates a heating device 28H to thereby heat the semiconductor circuit board 1 mounted on the mounting surface 28*a* to predetermined temperature under the control of the control section 14.

The location of the mounting surface 27*a* when the first stage 27 is located on the X-direction side corresponds to the first staging place 9*a*, and the location of the mounting surface 28*a* when the second stage 28 is located on the X-direction side corresponds to the second staging place 9*b*. The staging place 9*c* corresponding to the first staging place 9*a* and the second staging place 9*b* is located within the operation range of the grip section 13*a*, and the mounting surface 27*a* and the mounting surface 28*a* are exposed in the staging place 9*c*. Therefore, the conveying section 13 can easily mount the semiconductor circuit board 1 on the mounting surfaces 27*a*, 28*a*. After the preprocessing is performed on the semiconductor circuit board 1, the semiconductor circuit board 1 stands ready on the mounting surface 27*a* located at the first staging place 9*a* or the mounting surface 28*a* located at the second staging place 9*b*. Therefore, the grip section 13*a* of the conveying section 13 can move while easily gripping the semiconductor circuit board 1.

On the −X-direction side of the base 24, there is erected a support section 29 having a plate-like shape. On the X-direction side of the support section 29, a guide rail 30 extending in the Y direction is disposed on the upper side thereof. Further, in the place opposed to the guide rail 30, there is disposed a carriage 31 moving along the guide rail 30. The carriage 31 is provided with a translation mechanism, and is able to reciprocate. As the translation mechanism, a mechanism substantially the same as the translation mechanism provided to the elevating device 16 can be used, for example.

On the base 24 side of the carriage 31, there is disposed a processing section 32. As the processing section 32, there can be cited a low-pressure mercury vapor lamp, a hydrogen burner, an excimer laser, a plasma discharge section, a corona discharge section, and so on as an example. In the case of using the mercury vapor lamp, by irradiating the semiconductor circuit board 1 with ultraviolet light, the liquid-repellent property of the surface of the semiconductor circuit board 1 can be reformulated. In the case of using the hydrogen burner, the oxidized surface of the semiconductor circuit board 1 can be roughened by partial reduction of the surface, in the case of using the excimer laser, the surface of the semiconductor circuit board 1 can be roughened by partial melt-solidification of the surface thereof, and in the case of using the plasma discharge or the corona discharge, the surface of the semiconductor circuit board 1 can be roughened by mechanically grinding the surface thereof. In the present embodiment, the mercury vapor lamp is adopted, for example. The preprocessing section 9 makes the carriage 31 reciprocate while irradiating the semiconductor circuit board 1 with the ultraviolet light from the processing section 32 in the condition of heating the semiconductor circuit board 1 with the heating devices 27H, 28H. Thus, the preprocessing section 9 is arranged to be able to irradiate a large area of the processing place 9*d* with the ultraviolet light.

The preprocessing section 9 is entirely covered by an exterior section 33. Inside the exterior section 33, there is disposed a door section 34 capable of moving up and down. Further, as shown in FIG. 3B, after the first stage 27 or the second stage 28 moves to the place opposed to the carriage 31, the door section 34 falls. Thus, it is arranged to prevent the ultraviolet light emitted from the processing section 32 from leaking outside the preprocessing section 9.

When either one of the mounting surface 27*a* and the mounting surface 28*a* is located in the staging place 9*c*, the conveying section 13 supplies the mounting surface 27*a* or the mounting surface 28*a* with the semiconductor circuit board 1. Subsequently, the preprocessing section 9 moves either one of the first stage 27 and the second stage 28 on which the semiconductor circuit board 1 is mounted to the processing place 9*d*, and then performs the preprocessing. After the preprocessing is terminated, the preprocessing section 9 moves the first stage 27 or the second stage 28 to the staging place 9*c*. Subsequently, the conveying section 13 removes the semiconductor circuit board 1 from the mounting surface 27*a* or the mounting surface 28*a*.

Cooling Section

The cooling section 11 is provided with cooling plates 110*a*, 110*b* such as heat sinks respectively disposed in the processing places 11*a*, 11*b*, and each having an upper surface functioning as an adsorptive retention surface for the semiconductor circuit board 1.

The processing places 11*a*, 11*b* (cooling plates 110*a*, 110*b*) are located inside the operation range of the grip section 13*a*, and the cooling plates 110*a*, 110*b* are exposed in the processing places 11*a*, 11*b*. Therefore, the conveying section 13 can easily mount the semiconductor circuit board 1 on the cooling plates 110*a*, 110*b*. After the cooling process is performed on the semiconductor circuit board 1, the semiconductor circuit board 1 stands ready on the cooling plate 110*a* located at the processing place 11*a* or the cooling plate 110*b* located at the processing place 11*b*. Therefore, the grip section 13*a* of the conveying section 13 can move while easily gripping the semiconductor circuit board 1.

Application Section

Then, the application section 10 for ejecting droplets to and thereby forming marks on the semiconductor circuit board 1 will be explained with reference to FIGS. 4A through 4D. Although there can be cited a variety of types of devices with respect to the devices for ejecting droplets, a device using an inkjet method is preferable. The inkjet method allows ejection of microscopic droplets, and is therefore suitable for microfabrication.

Figure 4A:
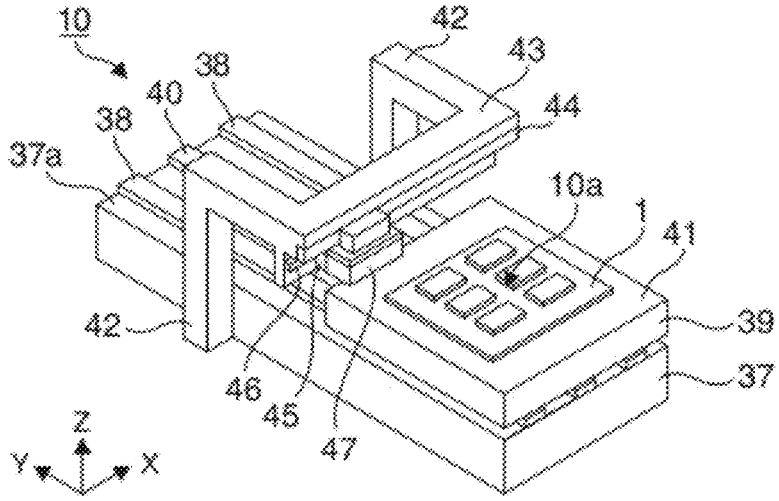
FIG. 4A is a schematic perspective view showing a configuration of an application section.

FIG. 4A is a schematic perspective view showing a configuration of the application section. The application section 10 ejects the droplets to the semiconductor circuit board 1. As shown in FIG. 4A, the application section 10 is provided with a base 37 formed to have a rectangular solid shape. The direction in which the droplet ejection head and the ejection target object move relatively to each other when ejecting the droplets is defined as a main scanning direction. Further, a direction perpendicular to the main scanning direction is defined as a sub-scanning direction. The sub-scanning direction corresponds to the direction in which the droplet ejection head and the ejection target object move relatively to each other when feeding line. In the present embodiment, it is assumed that the X direction is the main scanning direction, and the Y direction is the sub-scanning direction.

On the upper surface 37*a* of the base 37, there are disposed a pair of guide rails 38 extending in the Y direction across the full width thereof in the Y direction so as to protrude from the surface. Above the base 37, there is attached a stage 39 provided with a translation mechanism, not shown, corresponding to the pair of guide rails 38. As the translation mechanism of the stage 39, there can be used a linear motor or a screw type translation mechanism. In the present embodiment, a linear motor is adopted, for example. Further, it is arranged that the translation mechanism moves back and forth along the Y direction at a predetermined speed. Moving back and forth repeatedly is referred to as scanning movement. Further, on the upper surface 37*a* of the base 37, there is disposed a sub-scanning position detecting device 40 in parallel to the guide rails 38, and the sub-scanning position detecting device 40 detects the location of the stage 39.

On the upper surface of the stage 39, there is formed a mounting surface 41, and a suction type board chuck mechanism, not shown, is disposed on the mounting surface 41. After the semiconductor circuit board 1 is mounted on the mounting surface 41, the board chuck mechanism fixes the semiconductor circuit board 1 to the mounting surface 41.

The position of the mounting surface 41 when the stage 39 is located on the −Y-direction side corresponds to the staging place 10*a*. The mounting surface 41 is disposed so as to be exposed within the operation range of the grip section 13*a*. Therefore, the conveying section 13 can easily mount the semiconductor circuit board 1 on the mounting surface 41. After the application is performed on the semiconductor circuit board 1, the semiconductor circuit board 1 stands ready on the mounting surface 41 as the staging place 10*a*. Therefore, the grip section 13*a* of the conveying section 13 can move while easily gripping the semiconductor circuit board 1.

On both sides of the base 37, the sides being located in the X direction, there is erected a pair of support platforms 42, and the pair of support platforms 42 are bridged with a guide member 43 extending in the X direction. On a lower part of the guide member 43, there is disposed a guide rail 44 extending in the X direction across the full width thereof in the X direction so as to protrude from the surface thereof. The carriage 45 attached movably along the guide rail 44 is formed to have a roughly rectangular solid shape. The carriage 45 is provided with a translation mechanism, and as the translation mechanism, a mechanism substantially the same as the translation mechanism provided to the stage 39 can be used. Further, the carriage 45 performs the scanning movement along the X direction. A main scanning position detecting device 46 is disposed between the guide member 43 and the carriage 45, and thus the location of the carriage 45 can be measured. On the lower side of the carriage 45, there is disposed a head unit 47, and the droplet ejection head, not shown, is disposed on a surface of the head unit 47, the surface being located on the stage 39 side, so as to protrude from the surface thereof.

Figure 4B:
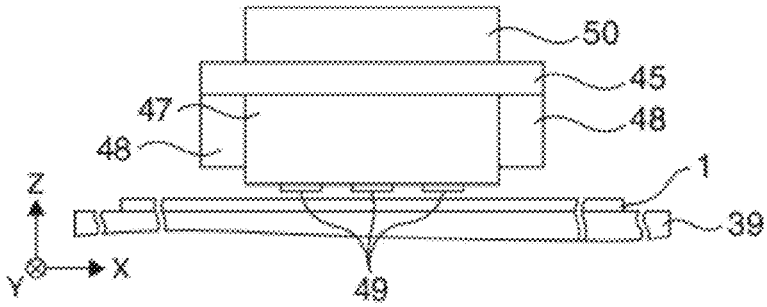
FIG. 4B is a schematic side view showing a carriage.

FIG. 4B is a schematic side view showing the carriage. As shown in FIG. 4B, on the semiconductor circuit board 1 side of the carriage 45, there are disposed the head unit 47 and a pair of curing units 48 as an irradiation section. On the semiconductor circuit board 1 side of the head unit 47, there are disposed three droplet ejection heads 49 for ejecting the droplets so as to protrude from the surface thereof. The number and the arrangement of the droplet ejection heads 49 are not particularly limited, but can be set in accordance with the types of the functional fluid to be ejected and the drawing pattern.

Inside each of the curing units 48, there is disposed an irradiation device for emitting the ultraviolet light for curing the droplets thus ejected. The curing units 48 are disposed at positions across the head unit 47 in the main scanning direction. The irradiation device is composed of a light emitting unit, a radiator plate, and so on. The light emitting unit is provided with a number of light emitting diode (LED) elements arranged. The LED elements are each an element supplied with electricity and emitting ultraviolet light as the light of an ultraviolet ray.

On the upper side in the drawing of the carriage 45, there is disposed a reservoir 50, and the reservoir 50 reserves the functional fluid. The droplet ejection head 49 and the reservoir 50 are connected to each other via a tube not shown, and the functional fluid in the reservoir 50 is supplied to the droplet ejection head 49 via the tube.

The functional fluid has a resin material, a photopolymerization initiator as a curing agent, and a solvent or a dispersion medium as primary materials. By adding a colorant such as a pigment or a dye, or a functional material such as a lyophilic or lyophobic surface modification material to the primary materials, the functional fluid having a unique function can be formed. In the present embodiment, a white pigment is added, for example. The resin material of the functional fluid is a material for forming the resin film. The resin material is not particularly limited so long as it is in the liquid form at normal temperature, and can form a polymer through polymerization. Further, the resin materials with low viscosity are preferable, and those in oligomeric form are preferable. Those in monomeric form are further preferable. The photopolymerization initiator is an additive agent acting on the crosslinkable group of the polymer to promote the cross-linking reaction, and benzyl dimethyl ketal and so on can be used as the photopolymerization initiator. The solvent or the dispersion medium is for adjusting the viscosity of the resin material. By making the functional fluid have a viscosity easy to eject from the droplet ejection head, it becomes possible for the droplet ejection head to stably eject the functional fluid.

Figure 4C:
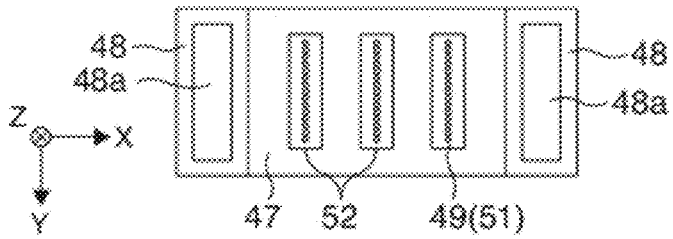
FIG. 4C is a schematic plan view showing a head unit.

FIG. 4C is a schematic plan view showing the head unit. As shown in FIG. 4C, the head unit 47 is provided with the droplet ejection heads 49, and a nozzle plate 51 is disposed on the surface of each of the droplet ejection heads 49. Each of the nozzle plates 51 is provided with a plurality of nozzles 52 formed in an arrangement. The number and the arrangement of the nozzles and the heads are not particularly limited, and are set in accordance with the ejection pattern. In the present embodiment, for example, a single array of the nozzles 52 is provided to each of the nozzle plates 51, and the 15 nozzles 52 are arranged in each of the arrays.

The lower surface of each of the curing units 48 is provided with an irradiation opening 48*a*. Further, the ultraviolet light emitted by the irradiation device is emitted from the irradiation openings 48*a* toward the semiconductor circuit board 1.

Figure 4D:
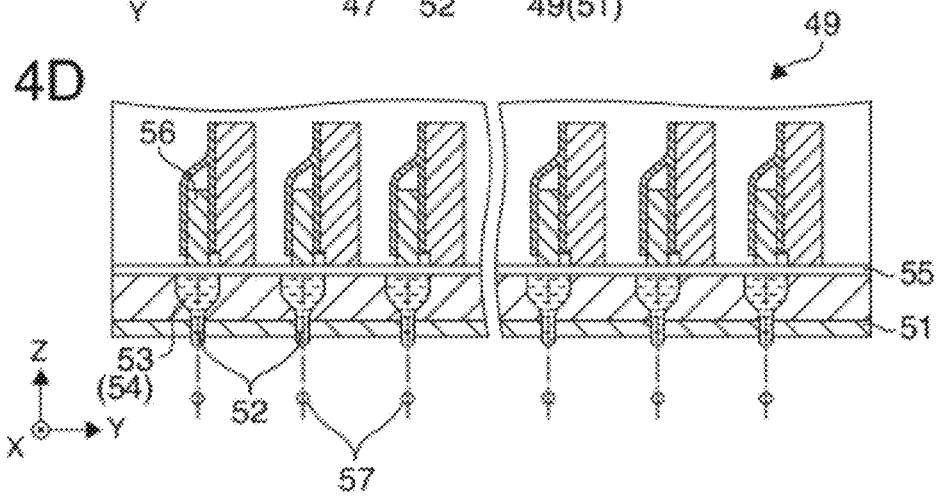
FIG. 4D is a schematic cross-sectional view of a substantial part for explaining a structure of a droplet ejection head.

FIG. 4D is a schematic cross-sectional view of a substantial part of the droplet ejection head for explaining the structure of the droplet ejection head. As shown in FIG. 4D, each of the droplet ejection heads 49 is provided with the nozzle plate 51, and each of the nozzle plates 51 is provided with the nozzles 52. On the upper side of the nozzle plate 51 and at positions corresponding respectively to the nozzles 52, there are formed cavities 53 communicating with the respective nozzles 52. Further, the cavities 53 of each of the droplet ejection heads 49 are supplied with the functional fluid 54.

On the upper side of each of the cavities 53, there is disposed a diaphragm 55 vibrating in a vertical direction to thereby expand and contract the internal volume of the cavity 53. On the upper side of each of the diaphragms 55 and at the place opposed to each of the cavities 53, there is disposed a piezoelectric element 56 extending and contracting in a vertical direction to thereby vibrate the diaphragm 55. The piezoelectric element 56 extends and contracts in the vertical direction to thereby pressurize and vibrate the diaphragm 55, and the diaphragm 55 decreases and increases the internal volume of the cavity 53 to thereby pressurize the cavity 53. Thus, the pressure in the cavity 53 varies, and the functional fluid 54 supplied in the cavity 53 is ejected through the nozzle 52.

When each of the droplet ejection heads 49 receives a nozzle drive signal for controlling the drive of the piezoelectric element 56, the piezoelectric element 56 extends to cause the diaphragm 55 to decrease the internal volume of the cavity 53. As a result, a corresponding amount of the functional fluid 54 to the amount of decrease in the volume is ejected as a droplet 57 from the nozzle 52 of the droplet ejection head 49. It is arranged that the semiconductor circuit board 1 to which the functional fluid 54 is applied is irradiated with the ultraviolet light from the irradiation openings 48*a* to thereby solidify or cure the functional fluid 54 including the curing agent.

Storage Section

Figure 5A:
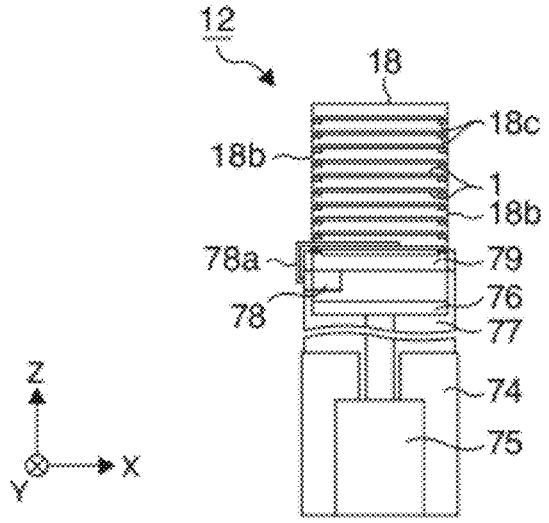
FIGS. 5A through 5C are schematic diagrams showing a storage section.
Figure 5B:
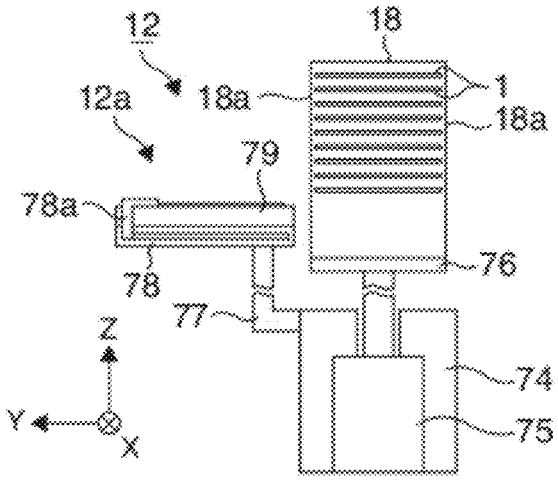
Figure 5C:
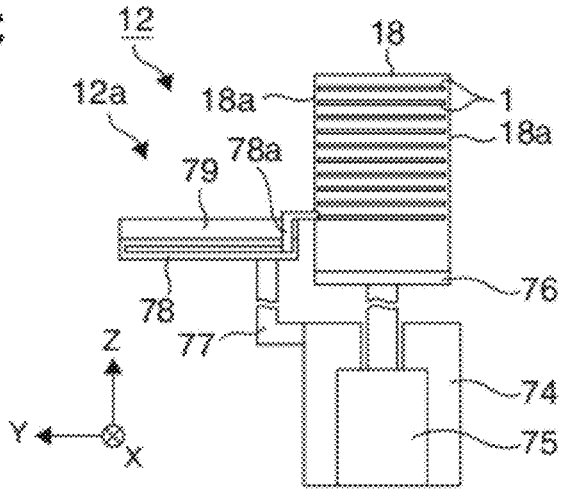

FIG. 5A is a schematic front view showing the storage section, and FIGS. 5B and 5C are schematic side views showing the storage section. As shown in FIGS. 5A and 5B, the storage section 12 is provided with a base 74. Inside the base 74, there is installed an elevating device 75. As the elevating device 75, a device substantially the same as the elevating device 16 installed in the supply section 8 can be used. Above the base 74, there is disposed an elevating plate 76 connected to the elevating device 75. Further, the elevating plate 76 is moved up and down by the elevating device 75. On the elevating plate 76, there is disposed a storage container 18 having a rectangular solid shape, and the semiconductor circuit boards 1 are stored in the storage container 18. As the storage container 18, there is used the same container as the storage container 18 installed in the supply section 8.

On the Y-direction side of the base 74, there are disposed a board push-out section 78 and a staging platform 79 via a support member 77. In the place located on the Y-direction side of the storage container 18, the staging platform 79 is disposed overlapping above the board push-out section 78. The board push-out section 78 is provided with an arm 78*a* moving in the Y direction, and a translation mechanism for driving the arm 78*a*. The translation mechanism is not particularly limited providing the mechanism moves linearly, and in the present embodiment, an air cylinder acting by the compressed air is adopted, for example. On the staging platform 79 there is mounted the semiconductor circuit board 1, and it is arranged that the arm 78*a* can have contact with the semiconductor circuit board 1 at the center of an end thereof on the Y-direction side.

By the board push-out section 78 moving the arm 78*a* in the −Y direction, the arm 78*a* moves the semiconductor circuit board 1 in the −Y direction. The staging platform 79 is provided with a recessed section having a width roughly the same as the X-direction width of the semiconductor circuit board 1, and the semiconductor circuit board 1 moves along the recessed section. Further, the position of the semiconductor circuit board 1 in the X direction is determined by the recessed section. As a result, as shown in FIG. 5C, the semiconductor circuit board 1 is moved inside the storage container 18. The storage container 18 is provided with rails 18*c*, and the rails are arranged to be located on the extended lines of the recessed section provided with the staging platform 79. Further, the semiconductor circuit board 1 is moved along the rails 18*c* by the board push-out section 78. Thus, the semiconductor circuit board 1 is stored in the storage container 18 with good quality.

After the conveying section 13 moves the semiconductor circuit board 1 to the upper surface of the staging platform 79, the elevating device 75 raises the storage container 18. Then, the board push-out section 78 drives the arm 78*a* to move the semiconductor circuit board 1 to the inside of the storage container 18. In such a manner as described above, the storage section 12 stores the semiconductor circuit board 1 inside the storage container 18. After a predetermined number of semiconductor circuit boards 1 are stored inside the storage container 18, the operator replaces the storage container 18 having the semiconductor circuit boards 1 stored with an empty storage container 18. Thus, the operator can carry the plurality of semiconductor circuit boards 1 to a subsequent process in a lump.

The storage section 12 has the staging place 12*a* for mounting the semiconductor circuit board 1 stored therein. The conveying section 13 can store the semiconductor circuit board 1 into the storage container 18 in cooperation with the storage section 12 only by mounting the semiconductor circuit board 1 on the staging place 12*a*.

Conveying Section

Figure 6:
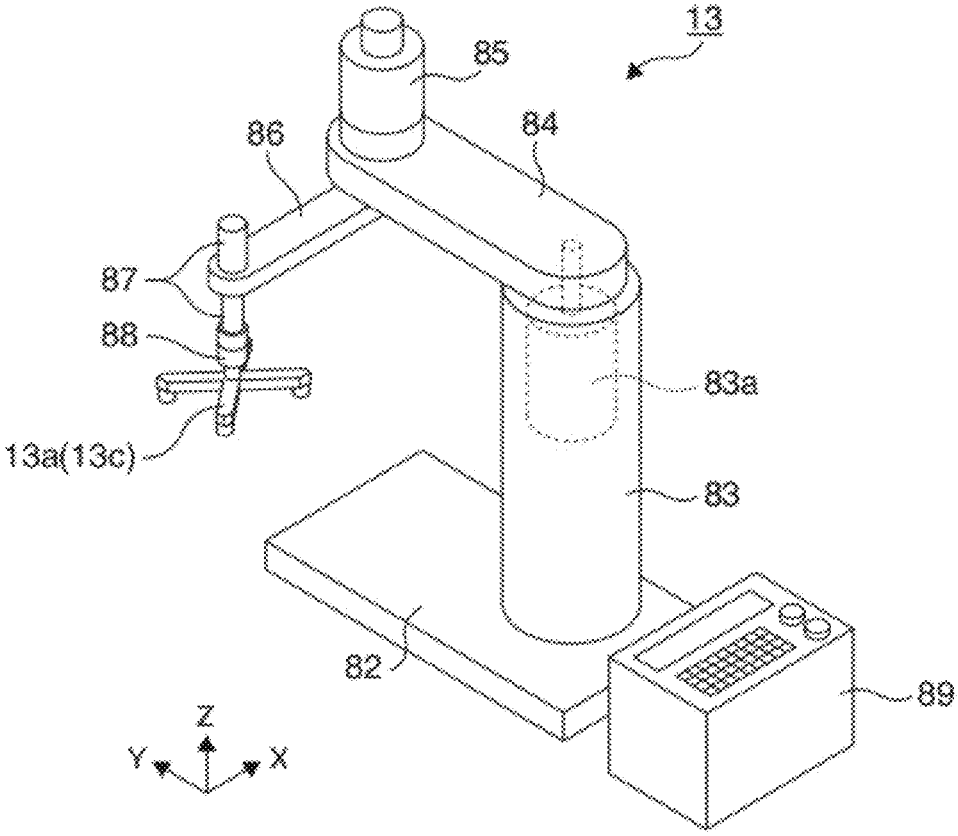
FIG. 6 is a schematic perspective view showing a configuration of a conveying section.

Then, the conveying section 13 for conveying the semiconductor circuit board 1 will be explained with reference to FIG. 6. FIG. 6 is a schematic perspective view showing a configuration of the conveying section. As shown in FIG. 6, the conveying section 13 is provided with a base 82 formed to have a plate-like shape. A support platform 83 is disposed on the base 82. A hollow space is formed inside the support platform 83, and a rotation mechanism 83*a* composed of an electric motor, an angle detector, a reduction mechanism, and so on is installed in the hollow space. Further, an output shaft of the electric motor is coupled to the reduction mechanism, and an output shaft of the reduction mechanism is coupled to a first arm section 84 disposed on the upper side of the support platform 83. Further, the angle detector is disposed so as to be coupled to the output shaft of the electric motor, and the angle detector detects the rotational angle of the output shaft of the electric motor. Thus, the rotation mechanism 83*a* can detect the rotational angle of the first arm section 84 to thereby rotate the first arm section 84 to a desired angular position.

A rotation mechanism 85 is disposed at an end of the upper surface of the first arm section 84, the end being opposite to the support platform 83. The rotation mechanism 85 is composed of an electric motor, an angle detector, a reduction mechanism, and so on, and has a function substantially the same as that of the rotation mechanism installed inside the support platform 83. Further, an output shaft of the rotation mechanism 85 is coupled to a second arm section 86. Thus, the rotation mechanism 85 can detect the rotational angle of the second arm section 86 to thereby rotate the second arm section 86 to a desired angular position.

An elevating device 87 is disposed at an end of the upper surface of the second arm section 86, the end being opposite to the rotation mechanism 85. The elevating device 87 is provided with a translation mechanism, and can extend and contract by driving the translation mechanism. As the translation mechanism, a mechanism substantially the same as that of the elevating device 16 of the supply section 8 can be used. On the lower side of the elevating device 87, there is disposed a rotation device 88.

The rotation device 88 is only required to be able to control the rotational angle, and can be composed of a variety of types of electric motors and a rotational angle sensor combined with each other. Besides the above, a step motor which can rotate at a predetermined rotational angle can also be used. In the present embodiment, a step motor is adopted, for example. Further, a reduction device can also be disposed. It becomes possible to rotate at a finer angular pitch.

On the lower side in the drawing of the rotation device 88, the grip section 13*a* is disposed. Further, the grip section 13*a* is coupled to the rotation shaft of the rotation device 88. Therefore, the conveying section 13 can rotate the grip section 13*a* by driving the rotation device 88. Further, the conveying section 13 can move up and down the grip section 13*a* by driving the elevating device 87.

The grip section 13*a* has four linear fingers 13*c*, and at the tip of each of the fingers 13*c*, there is formed an adsorption mechanism for adsorbing the semiconductor circuit board 1 by suctioning. Further, the grip section 13*a* can operate the adsorption mechanism to thereby grip the semiconductor circuit board 1.

On the −Y-direction side of the base 82, there is disposed a control device 89. The control device 89 is provided with a central processing unit, a storage section, an interface, an actuator drive circuit, an input device, a display device, and so on. The actuator drive circuit is a circuit for driving the rotation mechanism 83*a*, the rotation mechanism 85, the elevating device 87, the rotation device 88, and the adsorption mechanisms of the grip section 13*a*. Further, these devices and circuits are connected to the central processing unit via the interface. In addition thereto, an angle detector is also connected to the central processing unit via the interface. The storage section stores a software program representing the operation procedure for controlling the conveying section 13 and the data used for the control. The central processing unit is a device for controlling the conveying section 13 with the software program. The control device 89 obtains the outputs of the detectors disposed in the conveying section 13 to thereby detect the location and the posture of the grip section 13*a*. Further, the control device 89 performs the control of moving the grip section 13*a* to a predetermined position by driving the rotation mechanism 83*a* and the rotation mechanism 85.

Printing Method

Figure 7:
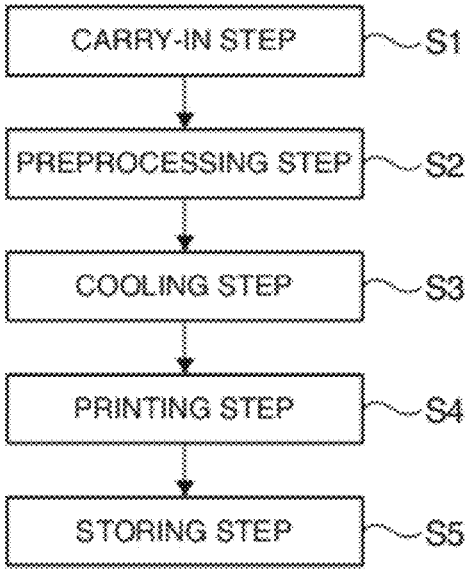
FIG. 7 is a flowchart showing a printing method.

Then, the printing method using the printer 7 described above will be explained with reference to FIG. 7. FIG. 7 is a flowchart showing the printing method.

As shown in the flowchart of FIG. 7, the printing method is mainly composed of a carry-in step S1 for carrying in the semiconductor circuit board 1 from the storage container 18, a preprocessing step (a first step) S2 of performing the preprocessing on the surface of the semiconductor circuit board 1 thus carried in, a cooling step (a second step) S3 of cooling the semiconductor circuit board 1 raised in temperature in the preprocessing step S2, a printing step (a third step) S4 of graphically printing a variety of marks on the semiconductor circuit board 1 thus cooled, and a storing step S5 of storing the semiconductor circuit board 1 on which the variety of marks are printed to the storage container 18.

Among the steps described above, the preprocessing step S2 through the printing step S4 are the characterizing portion of the invention, and therefore, the characterizing portion will be explained in the following description.

In the preprocessing step S2, either one of the first stage 27 and the second stage 28 is located in the staging place 9*c* in the preprocessing section 9. The conveying section 13 moves the grip section 13*a* to the place opposed to the stage located in the staging place 9*c*. Subsequently, the conveying section 13 moves down the grip section 13*a*, and then releases the adsorption of the semiconductor circuit board 1 to thereby mount the semiconductor circuit board 1 on either one of the first stage 27 and the second stage 28 located in the staging place 9*c*. As a result, as shown in FIG. 3B, the semiconductor circuit board 1 is mounted on the first stage 27 located in the staging place 9*c*. Alternatively, as shown in FIG. 3A, the semiconductor circuit board 1 is mounted on the second stage 28 located in the staging place 9*c*.

The first and second stages 27, 28 are heated in advance by the heating devices 27H, 28H, and therefore the semiconductor circuit board 1 mounted on either one of the first stage 27 and the second stage 28 is heated promptly to a predetermined temperature. The temperature to which the semiconductor circuit board 1 is heated is preferably the temperature at which the surface of the semiconductor circuit board 1 (the surface of the semiconductor 3) can effectively be reformulated or the elimination of organic substances from the surface can efficiently be performed, and at the same time, equal to or lower than the allowable temperature limit of the semiconductor circuit board 1 (including the semiconductor device 3) as described later, and in the present embodiment, the semiconductor circuit board 1 is heated to the temperature of, for example, 180° C. so that the temperature is within the range of 150° C. through 200° C.

Further, when the conveying section 13 moves the semiconductor circuit board 1 to the upper surface of the first stage 27, the preprocessing is performed on the semiconductor circuit board 1 on the second stage 28 in the processing place 9*b* located inside the preprocessing section 9. Subsequently, after the preprocessing of the semiconductor circuit board 1 on the second stage 28 is terminated, the second stage 28 moves the semiconductor circuit board 1 to the second staging place 9*b*. Subsequently, the preprocessing section 9 drives the first stage 27 to thereby move the semiconductor circuit board 1 mounted on the first staging place 9*a* to the processing place 9*d* opposed to the carriage 31. Thus, it is possible to start the preprocessing of the semiconductor circuit board 1 on the first stage 27 immediately after the preprocessing of the semiconductor circuit board 1 on the second stage 28 is terminated.

Subsequently, in the preprocessing section 9, the semiconductor device 3 mounted on the semiconductor circuit board 1 is irradiated with the ultraviolet light. Thus, the chemical bonding of the organic irradiation target object in the surface layer of the semiconductor device 3 is broken, and at the same time, the radical oxygen separated from the ozone generated by the ultraviolet ray is bonded to the molecule thus broken in the surface layer to thereby be converted into a functional group (e.g., —OH, —COH, or —COOH) with high hydrophilicity. Thus, the surface of the semiconductor circuit board 1 can be reformulated, and at the same time, the elimination of the organic substances on the surface can be performed. Here, the semiconductor device 3 (the semiconductor circuit board 1) is irradiated with the ultraviolet light in the condition of being previously heated at 180° C. as described above, the surface thereof can effectively be reformulated with the increased collision speed of the molecules in the surface layer without exerting damages to the semiconductor circuit board 1, and at the same time, the organic substances on the surface can efficiently be eliminated. By driving the first stage 27 after performing the preprocessing, the preprocessing section 9 moves the semiconductor circuit board 1 to the first staging place 9*a*.

Similarly, when the conveying section 13 moves the semiconductor circuit board 1 to the upper surface of the second stage 28, the preprocessing is performed on the semiconductor circuit board 1 on the first stage 27 in the processing place 9*b* located inside the preprocessing section 9. Subsequently, after the preprocessing of the semiconductor circuit board 1 on the first stage 27 is terminated, the first stage 27 moves the semiconductor circuit board 1 to the first staging place 9*a*. Subsequently, the preprocessing section 9 drives the second stage 28 to thereby move the semiconductor circuit board 1 mounted on the second staging place 9*b* to the processing place 9*d* opposed to the carriage 31. Thus, it is possible to start the preprocessing of the semiconductor circuit board 1 on the second stage 28 immediately after the preprocessing of the semiconductor circuit board 1 on the first stage 27 is terminated. Subsequently, the preprocessing section 9 irradiates the semiconductor device 3 mounted on the semiconductor circuit board 1 with the ultraviolet ray to thereby make it possible to effectively reformulate the surface without exerting damages to the semiconductor circuit board 1, and at the same time, efficiently eliminate the organic substances on the surface similarly to the case of the semiconductor circuit board 1 on the first stage 27 described above. By driving the second stage 28 after performing the preprocessing, the preprocessing section 9 moves the semiconductor circuit board 1 to the second staging place 9*b*.

When the preprocessing of the semiconductor circuit board 1 is completed in the preprocessing step S2, and the process proceeds to the cooling step S3, the conveying section 13 mounts the semiconductor circuit board 1 located in the staging place 9*c* on the cooling plate 110*a* or 110*b* disposed respectively in the processing places 11*a*, 11*b*. Thus, the semiconductor circuit board 1 heated in the preprocessing step S2 is cooled (temperature adjustment) for a predetermined period of time to the temperature (e.g., the room temperature) suitable for performing the printing step S4.

The semiconductor circuit board 1 thus cooled in the cooling step S3 is conveyed by the conveying section 13 to the upper surface of the stage 39 located in the staging place 10*a* of the application section 10. In the printing step S5, the application section 10 operates the chuck mechanism to hold the semiconductor circuit board 1 mounted on the stage 39 to the stage 39. Subsequently, the application section 10 ejects the droplets 57 from the nozzles 52 provided to the droplet ejection heads while performing the scanning movement of the stage 39 and the carriage 45. Thus, the marks such as the company name mark 4, the model code 5, and the serial number 6 are drawn on the surface of each of the semiconductor devices 3. Subsequently, the marks are irradiated with the ultraviolet ray from the curing units 48 installed in the carriage 45. Thus, since the photopolymerization initiator for starting the polymerization by the ultraviolet ray is included in the functional fluid 54 for forming the mark, the surfaces of the marks are immediately solidified or cured. After performing the printing, the application section 10 moves the stage 39 on which the semiconductor circuit board 1 is mounted to the staging place 10*a*. Thus, it becomes possible to make it easy for the conveying section 13 to grip the semiconductor circuit board 1. Then, the application section 10 stops the operation of the chuck mechanism to thereby release holding of the semiconductor circuit board 1.

Subsequently, the semiconductor circuit board 1 is conveyed by the conveying section 13 to the storage section 12, and is then stored into the storage container 18 in the storage step S5.

As explained hereinabove, in the present embodiment since the semiconductor circuit board 1 is irradiated with the ultraviolet ray while being heated in the preprocessing step S2 prior to the printing step S4, the surface can effectively be reformulated with the increased collision speed of the molecules in the surface layer, and at the same time, the organic substances on the surface can efficiently be eliminated to thereby make it possible to effectively improve the adhesiveness of the marks (the print patterns) such as the company name mark 4, the model code 5, and the serial number 6. In particular, since in the present embodiment the semiconductor circuit board 1 is heated to the temperature in the range of 150° C. through 200° C., it is possible to effectively perform the surface reformulation and the organic substance elimination on the surface without exerting damages to the semiconductor devices 3.

Further, in the present embodiment, the activation light beam for curing the droplets in the printing step S4 and the activation light beam for performing the preprocessing in the preprocessing step S2 are derived from the same light source, both of the improvement in the adhesiveness of the print pattern to the semiconductor circuit board 1 (the semiconductor device 3) and the curing of the droplets ejected on the semiconductor circuit board 1 (the semiconductor device 3) can be performed, which can make a contribution to downsizing and price reduction of the device. In particular, in the present embodiment, since the ultraviolet ray is emitted using the low-pressure mercury vapor lamp, the reformulation process of the semiconductor circuit board 1 can be performed at low voltage, and at the same time, the preprocessing step can efficiently be performed using the heat generated by the irradiation of the ultraviolet ray.

Further, in the present embodiment, since the semiconductor circuit board 1 is cooled by providing the cooling step S3 after the preprocessing step S2 and prior to the printing step S4, wet-spreading of the droplets landed on the semiconductor device 3 can be prevented to thereby form a fine pattern.

Although the explanation is hereinabove presented regarding the preferable embodiment of the invention with reference to the accompanying drawings, it is obvious that the invention is not limited to such an example as described above. The various shapes and combinations of the constituents presented in the embodiment described above are provided for exemplification only, and can be modified in various ways within the spirit or scope of the invention in accordance with design needs and so on.

For example, although in the embodiment described above the ultraviolet curing ink such as UV ink is used, the invention is not limited thereto, but it is possible to use a variety of types of activation light curable ink for which a visible light beam or an infrared ray can be used as the curing light.

Further, the same can be applied to the light source, and it is possible to use a variety of types of activation light sources for emitting the activation light such as visible light, namely to use a variety of types of activation light beam irradiation sections.

Here, the "activation light beam" in the invention is not particularly limited providing the irradiation with the light beam can provide energy capable of generating a starting seed in the ink, and broadly includes alpha ray, gamma ray, X-ray, ultraviolet ray, visible light beam, electron beam, and so on. Among the above, from the viewpoint of the curing sensitivity and availability of the device, the ultraviolet ray and the electron beam are preferable, and the ultraviolet ray is particularly preferable. Therefore, it is preferable to use the ultraviolet curing ink, which can be cured by being irradiated with the ultraviolet light, as the activation light curing ink, as in the case of the present embodiment.

Although in the embodiment described above the cooling section 11 has the cooling plates 110*a*, 110*b* such as heat sinks, it is also possible to leave the semiconductor circuit board 1 thus heated in the atmosphere at lower temperature for a predetermined period of time to thereby cool the semiconductor circuit board 1 to predetermined temperature.

Although in the embodiment described above, the first stage 27 incorporates the heating device 27H, and the second stage 28 incorporates the heating device 28H, it is also possible that no heating device is incorporated in the preprocessing section, and it is arranged that the semiconductor circuit board 1 is heated before the semiconductor circuit board 1 is conveyed to the preprocessing section, and the semiconductor circuit board 1 in the heated state is conveyed to the preprocessing section.

The entire disclosure of Japanese Patent Application No. 2010-267396, filed Nov. 30, 2010 is expressly incorporated by reference herein.

What is claimed is:

1. A printing method comprising:

preprocessing a substrate by irradiating the substrate in a heated state with an activation light beam while the substrate is on a preprocessing station;

transferring the substrate from the preprocessing station to a cooling station by a handler so as to move the substrate through the air;

after the preprocessing, cooling the substrate while the substrate is on the cooling station;

transferring the substrate from the cooling station to a printing station by the handler so as to move the substrate through the air; and after the cooling, printing a predetermined pattern on the substrate by ejecting a droplet to the substrate while the substrate is on a printing station, wherein the activation light beam is one of an alpha ray, a gamma ray, an X-ray, an ultraviolet ray and an electron beam to reformulate a surface of the substrate, and the cooling station is independently and separately located from the preprocessing station and the printing station.

2. The printing method according to claim 1, wherein in the preprocessing, the substrate is heated at a temperature that is one of equal to and lower than an allowable temperature limit of the substrate.

3. The printing method according to claim 1, wherein the droplet ejected to the substrate is a droplet of a fluid to be cured with the activation light beam.

4. The printing method according to claim 3, wherein the activation light beam is the ultraviolet ray.

5. A printing method comprising:

preprocessing a substrate by irradiating the substrate in a heated state with an activation light beam while the substrate is on a preprocessing station;

transferring the substrate from the preprocessing station to a cooling station by a handler so as to move the substrate through the air;

after the preprocessing, cooling the substrate while the substrate is on the cooling station;

transferring the substrate from the cooling station to a printing station by the handler so as to move the substrate through the air; and after the cooling, printing a predetermined pattern on the substrate by ejecting a droplet to the substrate while the substrate is on a printing station, wherein in the preprocessing, the substrate is heated at a temperature in a range of 150° C. through 200° C., and the cooling station is independently and separately located from the preprocessing station and the printing station.

6. A printing method comprising:

preprocessing a substrate by irradiating the substrate in a heated state with an activation light beam while the substrate is on a preprocessing station;

transferring the substrate from the preprocessing station to a cooling station by a handler so as to move the substrate through the air;

after the preprocessing, cooling the substrate while the substrate is on the cooling station;

transferring the substrate from the cooling station to a printing station by the handler so as to move the substrate through the air; and after the cooling, printing a predetermined pattern on the substrate by ejecting a droplet to the substrate while the substrate is on a printing station, wherein in the printing, the predetermined pattern is printed on a semiconductor device disposed on the substrate, and the cooling station is independently and separately located from the preprocessing station and the printing station.

7. A printer comprising:

a preprocessing section adapted to irradiate a substrate with an activation light beam while heating the substrate on a preprocessing station;

a cooling section adapted to cool the substrate that has been heated in the preprocessing section on a cooling station;

a printing section adapted to print a predetermined pattern on the substrate which has been cooled by the cooling section by ejecting a droplet to the substrate while the substrate is in a printing station; and a handler adapted to transfer the substrate from the preprocessing station to the cooling station through the air and from the cooling station to the printing station through the air, wherein the preprocessing section heats the substrate at a temperature in a range of 150° C. through 200° C., and the cooling station is independently and separately located from the preprocessing station and the printing station.

8. A printer comprising:

a preprocessing section that irradiates a substrate with an activation light beam while heating the substrate on a preprocessing station;

a cooling section adapted to cool the substrate that has been heated in the preprocessing section on a cooling station;

a printing section that prints a predetermined pattern on a semiconductor device disposed on the substrate which has been cooled by the cooling section, by ejecting a droplet to the semiconductor device while the substrate is in a printing station; and a handler adapted to transfer the substrate from the preprocessing station to the cooling station through the air and from the cooling station to the printing station through the air, wherein the cooling station is independently and separately located from the preprocessing station and the printing station.

* * * * *